US011465430B2

(12) United States Patent
Guo et al.

(10) Patent No.: US 11,465,430 B2
(45) Date of Patent: Oct. 11, 2022

(54) RIBBON CASSETTE, LABEL PRINTER, AND INSTALLATION METHOD THEREOF

(71) Applicant: ZHUHAI QUIN TECHNOLOGY CO., LTD., Zhuhai (CN)

(72) Inventors: Jinpeng Guo, Zhuhai (CN); Wei Du, Zhuhai (CN)

(73) Assignee: ZHUHAI QUIN TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 17/086,483

(22) Filed: Nov. 2, 2020

(65) Prior Publication Data

US 2022/0072886 A1 Mar. 10, 2022

(30) Foreign Application Priority Data

Sep. 4, 2020 (CN) ..... 202010921471.1

(51) Int. Cl.
*B41J 32/00* (2006.01)
*B41J 3/407* (2006.01)
*B41J 11/70* (2006.01)

(52) U.S. Cl.
CPC ..... *B41J 32/00* (2013.01); *B41J 3/4075* (2013.01); *B41J 11/703* (2013.01)

(58) Field of Classification Search
CPC ..... B41J 32/00; B41J 3/4075; B41J 11/703
See application file for complete search history.

(56) References Cited

U.S. PATENT DOCUMENTS 6,190,069 B1 * 2/2001 Yamaguchi ..... B26D 5/10 400/615.2
2010/0247210 A1 * 9/2010 Yamaguchi ..... B41J 32/00 400/207
2011/0211894 A1 * 9/2011 Sugino ..... B41J 33/04 400/207
2012/0080550 A1 * 4/2012 Yamaguchi ..... B41J 11/009 242/160.4
2012/0189365 A1 * 7/2012 Yamaguchi ..... B41J 35/28 400/207
2018/0015757 A1 * 1/2018 Nakai ..... B41J 15/044
2018/0015759 A1 * 1/2018 Tonishi ..... B41J 3/36

FOREIGN PATENT DOCUMENTS

JP 04135879 A * 5/1992

* cited by examiner

*Primary Examiner* — David H Banh

(57) ABSTRACT

The present disclosure provides a ribbon cassette, label printer, and installation method thereof. The ribbon cassette includes a cassette housing. A print head clamping groove, a side wall, and a position hole located inside the side wall are disposed on the cassette housing. A ribbon cutting part is formed at a connection between the side wall and the print head clamping groove. A first clamping accommodation part, a second clamping accommodation part, and a third clamping accommodation part are disposed on a surface of the cassette housing. The first clamping accommodation part, the second clamping accommodation part, and the third clamping accommodation part are respectively matched with a first position column, a second position column, and a third position column of a label printer.

12 Claims, 6 Drawing Sheets

RIBBON CASSETTE, LABEL PRINTER, AND INSTALLATION METHOD THEREOF

TECHNICAL FIELD

The present disclosure relates to a technical field of label ribbon cassettes, and in particular to a ribbon cassette, label printer, and installation method thereof where the ribbon cassette is easy to clamp and position.

BACKGROUND

Present ribbon cassettes have problems that the ribbon cassettes are improperly arranged because their guiding, positioning, and clamping structures are disposed improperly, which leads to issues that the ribbon cassettes are tilted and cannot be smoothly disassembled. Moreover, when clamping parts and position holes are not configured with a good balance, assembly force and pulling force are not balanced, which may also make the ribbon cassettes titled, to create a blocking resistance so that the ribbon cassettes are not disassembled smoothly.

In a printing process, the ribbon cassettes become loose due to absence of a good balance to configure the clamping parts and the position holes and guidance holes, and a cutter cannot cut smoothly, thereby affecting print quality.

In addition, the guidance holes or the clamping parts of the present ribbon cassettes are generally disposed on an outer peripheral surface of the ribbon cassettes, which increases an overall volume of the ribbon cassettes, or affects smooth appearance of the ribbon cassettes.

SUMMARY

A first object of the present disclosure is to provide a ribbon cassette which is stable and reliable in assembly positioning, accurate and complete in cutting, high in compatibility, small in size, simple in structure, and easy to produce and process.

A second object of the present disclosure is to provide a label printer including the ribbon cassette.

A third object of the present disclosure is to provide an installation method for the label printer and the ribbon cassette.

In order to achieve the first object, the present disclosure provides a ribbon cassette, including a cassette housing. A print head clamping groove, a side wall, and a position hole located inside the side wall are disposed on the cassette housing. A ribbon cutting part is formed at a connection between the side wall and the print head clamping groove. A first clamping accommodation part, a second clamping accommodation part, and a third clamping accommodation part are disposed on a surface of the cassette housing. The first clamping accommodation part, the second clamping accommodation part, and the third clamping accommodation part are respectively matched with a first position column, a second position column, and a third position column of a label printer. A central imaginary line of the first clamping accommodation part, a central imaginary line of the second clamping accommodation part, and a central imaginary line of the position hole form a triangular region.

Furthermore, the cassette housing includes an upper cassette housing and a lower cassette housing. The upper cassette housing and the lower cassette housing are detachably and fixedly connected.

Furthermore, the first clamping accommodation part, the second clamping accommodation part, and the third clamping accommodation part are disposed on a surface of the upper cassette housing. The lower cassette housing includes the side wall and the position hole located inside the side wall. The first clamping accommodation part, the second clamping accommodation part, and the third clamping accommodation part are in a same horizontal plane. The first clamping accommodation part and the position hole are in different horizontal planes.

Furthermore, a connecting line connected to the first clamping accommodation part and the second clamping accommodation part is a first imaginary line. A connecting line connected to the first clamping accommodation part and the position hole is a second imaginary line. A connecting line connected to the second clamping accommodation part and the position hole is a third imaginary line. An angle formed after connecting the first imaginary line with the second imaginary line is an acute angle, an angle formed after connecting the first imaginary line with the third imaginary line is an acute angle, and an angle formed after connecting the second imaginary line with the third imaginary line is an acute.

Furthermore, the print head clamping groove includes a first clamping part and a second clamping part. The first clamping part bends into the print head clamping groove to form a clamping inlet with the second clamping part.

Furthermore, the side wall includes an extension part, the ribbon cutting part is formed at a connection between the extension part and the second clamping part, so that the ribbon cutting part is located at the connection is at an acute angle between the extension part and the second clamping part.

In order to achieve the second object, the present disclosure provides a label printer, including a printer housing consisting of an upper cover assembly, a middle cover assembly, and a lower cover assembly, and the label printer further includes the ribbon cassette disposed inside the printer housing. A ribbon cassette placement part, configured to fix and hold the ribbon cassette, is disposed on the middle cover assembly. The first position column, the second position column, the third position column, and a position guidance column are disposed on the ribbon cassette placement part. The first position column, the second position column, and the third position column are respectively matched with the first clamping accommodation part, the second clamping accommodation part, and the third clamping accommodation part of the ribbon cassette, and the position guidance column is matched with the position hole of the ribbon cassette.

Furthermore, the middle cover assembly and the lower cover assembly form an accommodation cavity, and a paper feeding control mechanism is disposed inside the accommodation cavity. The paper feeding control mechanism includes a first frame, a rubber covered roller assembly, a gear assembly, and a stepper motor. The rubber covered roller assembly is rotatably disposed on the first frame, the gear assembly and the stepper motor are disposed on one side of the first frame, the stepper motor is in transmission connection with the gear assembly, and the stepper motor drives the gear assembly to rotate while driving the rubber covered roller assembly to rotate.

Furthermore, a paper cutter support assembly is disposed inside the accommodation cavity formed by the middle cover assembly and the lower cover assembly. The paper cutter support assembly includes a second frame and a paper cutting blade. The paper cutting blade is supported by a fulcrum on one side of the second frame and driven by a spring assembly. The paper cutting blade is configured to cut printing paper on the rubber covered roller assembly, and the spring assembly is supported by the second frame.

Furthermore, in order to achieve the third object, the present disclosure provides an installation method for the label printer and the ribbon cassette. The installation method is as following: in an installation process of the ribbon cassette, clamping a print head of the label printer into the print head clamping groove through the clamping inlet; matching and fixing the three position columns disposed on the label printer with the three clamping accommodation parts disposed on the ribbon cassette; matching and fixing the position guidance column disposed on the label printer with the position hole disposed on the ribbon cassette; forming the triangular region by the central imaginary line of the first clamping accommodation, the central imaginary line of the second clamping accommodation, and the central imaginary line of the third clamping accommodation to form a stable triangular structure; then limiting a degree of freedom of the ribbon cassette in all directions. In the above process, the print head is pressed to slightly open the clamping inlet through elasticity of plastic materials, when the print head is clamped into the print head clamping groove, the clamping inlet is self-restored, so that the ribbon cartridge is installed inside the label printer.

Therefore, the ribbon cassette of the present disclosure is accurately and smoothly assembled into a cassette installation part of the label printer. During printing, the present disclosure ensures that the ribbon cassette is positioned stably and the cutter does accurately and completely cut. An overall volume of the ribbon cassette is decreased, an internal capacity of the ribbon cassette is increased, and appearance fluency of the ribbon cassette is improved.

The present disclosure is further described below in conjunction with the accompanying drawings and embodiments.

DETAILED DESCRIPTION

In order to make the objects, technical solutions, and advantages of the embodiments of the present disclosure clearer, the technical solutions of the embodiments of the present disclosure are clearly and completely described in connection with the accompanying drawings of embodiments of the present disclosure. It is obvious that the described embodiments are part of the embodiments of the present disclosure and not all embodiments. Based on the described embodiments of the present disclosure, all other embodiments obtained by those skilled in the art without creative efforts are within scopes of the present disclosure.

Unless otherwise defined, technical and scientific terms used in the present disclosure is construed in a generic sense to those skilled in the art to which the present disclosure belongs. The terms "first", "second", and similar words used in the present disclosure do not denote any order, quantity, or importance, but are merely used to distinguish between different components. Likewise, similar words such as "a", "an" or "the" do not denote a limitation of quantity, but rather denote the presence of at least one. Terms such as "comprise" or "include" etc., are intended to mean that an element or object in front of the word encompasses elements or objects that appear behind the word and equivalents thereof, but do not exclude other elements or items. Similar words such as "connect" or "contact" are not limited to physical or mechanical connections, but may include electrical connections, whether direct or indirect. "upper", "lower", "left", "right", etc. are used merely to represent relative positional relationships, which may also change accordingly when the absolute position of the described object changes.

One embodiment of a ribbon cassette is as following.

Figure 1:
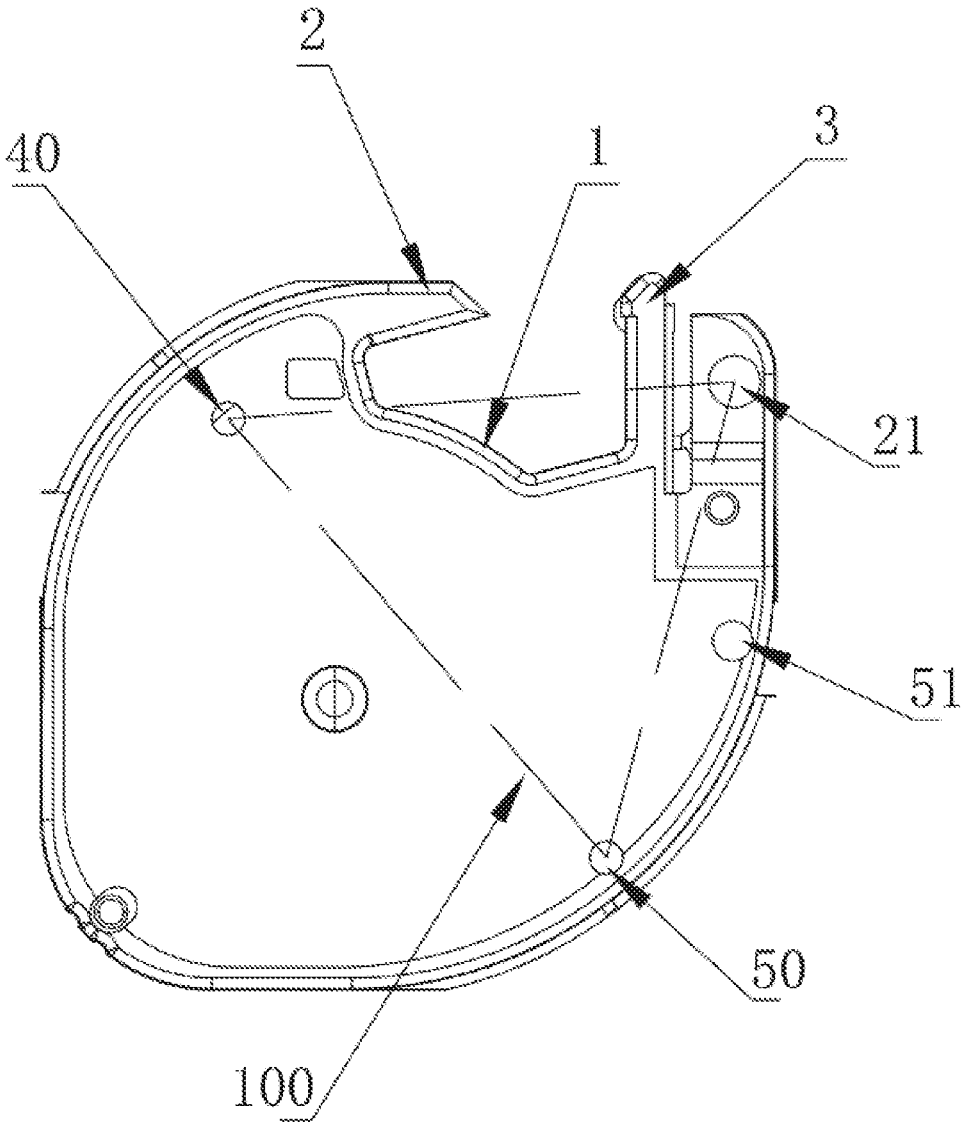
FIG. 1 is a structural schematic diagram of a ribbon cassette according to one embodiment of the present disclosure.
Figure 2:
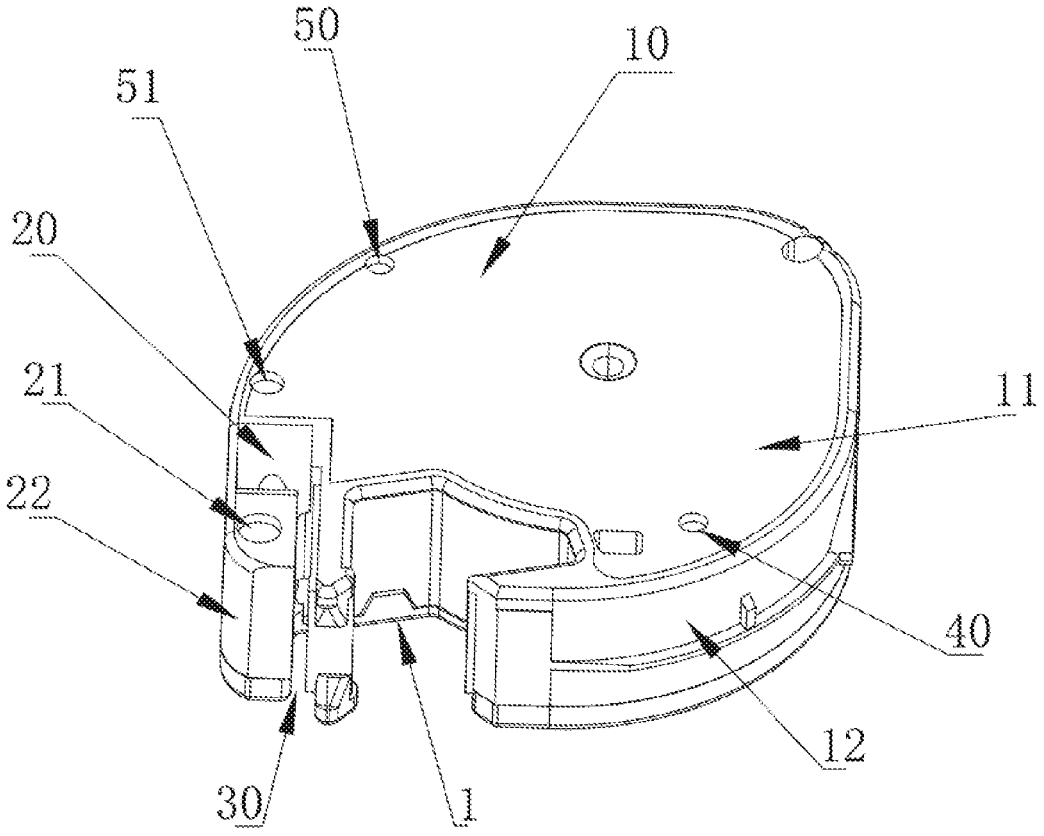
FIG. 2 is a structural schematic diagram of another angle of the ribbon cassette according to one embodiment of the present disclosure.

As shown in FIGS. 1-2, the present disclosure provides a ribbon cassette 200 which is easy to clamp and position. The ribbon cassette 200 includes a cassette housing 10. A print head clamping groove 1, a side wall 20, and a position hole 21 located inside the side wall 20 are disposed on the cassette housing 10. A ribbon cutting part 30 is formed at a connection between the side wall 20 and the print head clamping groove 1. A first clamping accommodation part 40, a second clamping accommodation part 50, and a third clamping accommodation part 51 are disposed on a surface of the cassette housing 10. The first clamping accommodation part 40, the second clamping accommodation part 50, and the third clamping accommodation part 51 are respectively matched with a first position column 71, a second position column 72, and a third position column 73 of a label printer 300. A central imaginary line of the first clamping accommodation part 40, a central imaginary line of the second clamping accommodation part 50, and a central imaginary line of the position hole 21 form a triangular region 100.

In one embodiment, the cassette housing 10 includes an upper cassette housing 11 and a lower cassette housing 12. The upper cassette housing 11 and the lower cassette housing 12 are detachably and fixedly connected.

The first clamping accommodation part 40, the second clamping accommodation part 50, and the third clamping accommodation part 51 are disposed on a surface of the upper cassette housing 11. The lower cassette housing 12 includes the side wall 20 and the position hole 21 located inside the side wall 20. The first clamping accommodation part 40, the second clamping accommodation part 50, and the third clamping accommodation part 51 are in a same horizontal plane. The first clamping accommodation part 40 and the position hole 21 are in different horizontal planes.

The print head clamping groove 1, the position hole 21, and the lower cassette housing 12 are in an integrated structure.

Therefore, the first clamping accommodation part 40, the second clamping accommodation part 50, and the third clamping accommodation part 51 are disposed inside the ribbon cassette 200. An opening is disposed on the lower cassette housing 21, the opening is configured to accommodate printer guidance shaft. The position hole 21 plays a role in guiding and positioning. So that an installation process of the label printer is smoother. Incorrect identification problems caused by incorrect positioning of the label printer 300 and the ribbon cassette 200 are also reduced, and printing effect is better and print quality is more guaranteed.

Specifically, a connecting line connected to the first clamping accommodation part 40 and the second clamping accommodation part 50 is a first imaginary line. A connecting line connected to the first clamping accommodation part 40 and the position hole 21 is a second imaginary line. A connecting line connected to the second clamping accommodation part 50 and the position hole 21 is a third imaginary line. An angle formed after connecting the first imaginary line with the second imaginary line is an acute angle, an angle formed after connecting the first imaginary line with the third imaginary line is an acute angle, and an angle formed after connecting the second imaginary line with the third imaginary line is an acute. The three imaginary lines of the first clamping accommodation part 40, the second clamping accommodation part 50, and the position hole 21 are connected, and three structures of the first clamping accommodation part 40, the second clamping accommodation part 50 form a stable triangular structure. The triangular structure has a stable relationship, and a buckle and a positioning hole are integrally disposed on an inner side of the ribbon cassette 200. So that a degree of freedom of the ribbon cassette 200 in all directions is limited, an overall volume of the ribbon cassette 200 is decreased, an internal capacity of the ribbon cassette 200 is increased, and appearance fluency of the ribbon cassette 200 is improved.

In addition, stable positioning of the ribbon cassette 200 is further ensured by disposing the third clamping accommodation part 51.

In one embodiment, at least one portion of the print head clamping groove 1 and the ribbon cutting part 30 overlaps the triangular region 100. Thereby, at least one portion of a print head insertion region and a ribbon cutting region is within the triangular region 100.

In one embodiment, the print head clamping groove 1 includes a first clamping part 2 and a second clamping part 3. The first clamping part 2 bends into the print head clamping groove 1 to form a clamping inlet with the second clamping part 3. An aperture of the clamping inlet is smaller than a length dimension of the print head clamping groove 1.

In one embodiment, the side wall 20 includes an extension part 22, the ribbon cutting part 30 is formed at a connection between the extension part 22 and the second clamping part 3, so that the ribbon cutting part 30 is located at the connection is at an acute angle between the extension part 22 and the second clamping part 3.

In one embodiment, the first clamping accommodation part 40 and the second clamping accommodation part 50 are square or circular in shape. Thereby, a shape of the clamping accommodation parts is square or circular, depending on a size and shape of the printer guidance shaft.

In an actual installation process of the ribbon cassette, the print head 111 of the label printer 300 is clamped into the print head clamping groove 1 through the clamping inlet. The print head 111 is pressed to slightly open the clamping inlet through elasticity of plastic materials, when the print head 111 is clamped into the print head clamping groove 1, the clamping inlet is self-restored. Thus, the ribbon cassette 200 is easy to install, is stable and reliable in positioning, and is applied to a label printer having a print head with a diameter smaller than or slightly larger than a diameter of the print head clamping groove 1. The ribbon cassette 200 is high in compatibility, simple in structure, easy to produce and process, and strong in market competitiveness, and is beneficial to mass production and popularization.

One embodiment of a label printer is as following.

Figure 3:
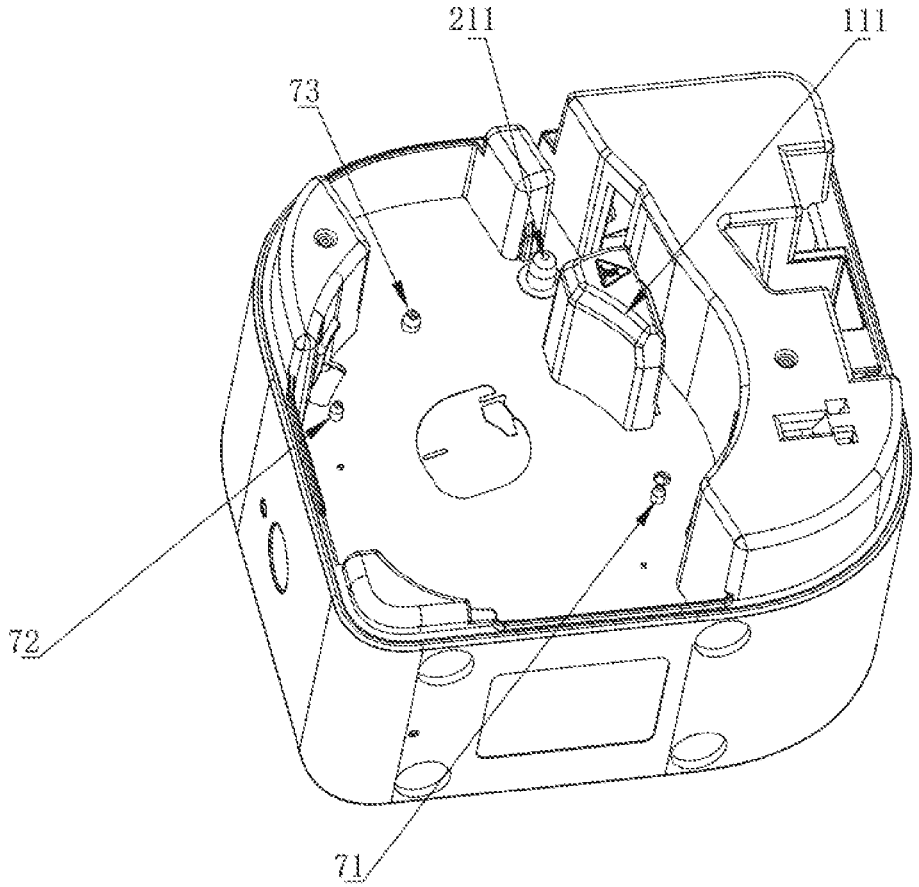
FIG. 3 is a structural schematic diagram of a label printer according to one embodiment of the present disclosure.
Figure 4:
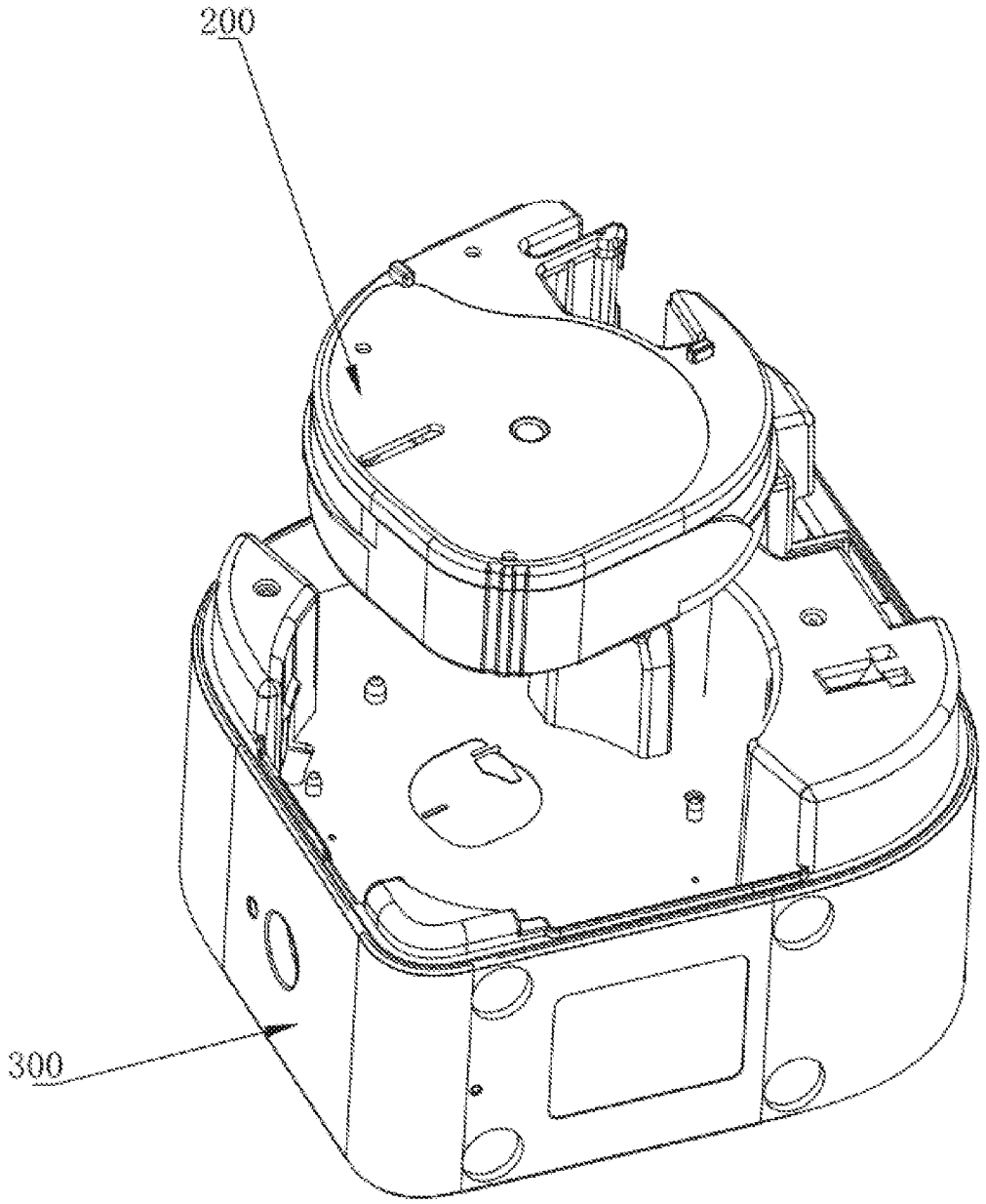
FIG. 4 is an assembly schematic diagram of the label printer and the ribbon cassette according to one embodiment of the present disclosure.
Figure 5:
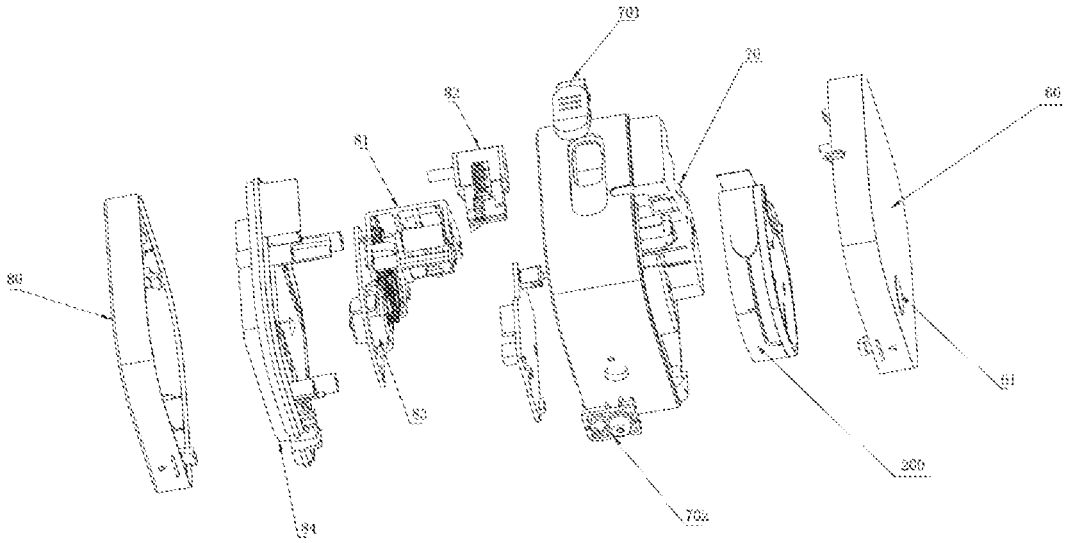
FIG. 5 is an exploded diagram of the label printer according to one embodiment of the present disclosure.

As shown in FIGS. 3-5, the present disclosure provides a label printer 300, including a printer housing consisting of an upper cover assembly 60, a middle cover assembly 70, and a lower cover assembly 80, and the label printer 300 further includes the ribbon cassette 200 disposed inside the printer housing. A ribbon cassette placement part, configured to fix and hold the ribbon cassette 200, is disposed on the middle cover assembly 70. The first position column 71, the second position column 73, the third position column 73, and a position guidance column 211 are disposed on the ribbon cassette placement part. The first position column 71, the second position column 72, and the third position column 73 are respectively matched with the first clamping accommodation part 40, the second clamping accommodation part 50, and the third clamping accommodation part 51 of the ribbon cassette 200, and the position guidance column 211 is matched with the position hole 21 of the ribbon cassette 200.

In one embodiment, the middle cover assembly 70 and the lower cover assembly 80 form an accommodation cavity, and a paper feeding control mechanism 81 and a battery cartridge assembly 84 are disposed inside the accommodation cavity. The paper feeding control mechanism 81 includes a first frame, a rubber covered roller assembly, a gear assembly, and a stepper motor 835. The rubber covered roller assembly is rotatably disposed on the first frame, the gear assembly and the stepper motor 835 are disposed on one side of the first frame, the stepper motor 835 is in transmission connection with the gear assembly, the gear assembly is in transmission connection with the rubber covered roller assembly, and the stepper motor 835 drives the gear assembly to rotate while driving the rubber covered roller assembly to rotate.

Figure 6:
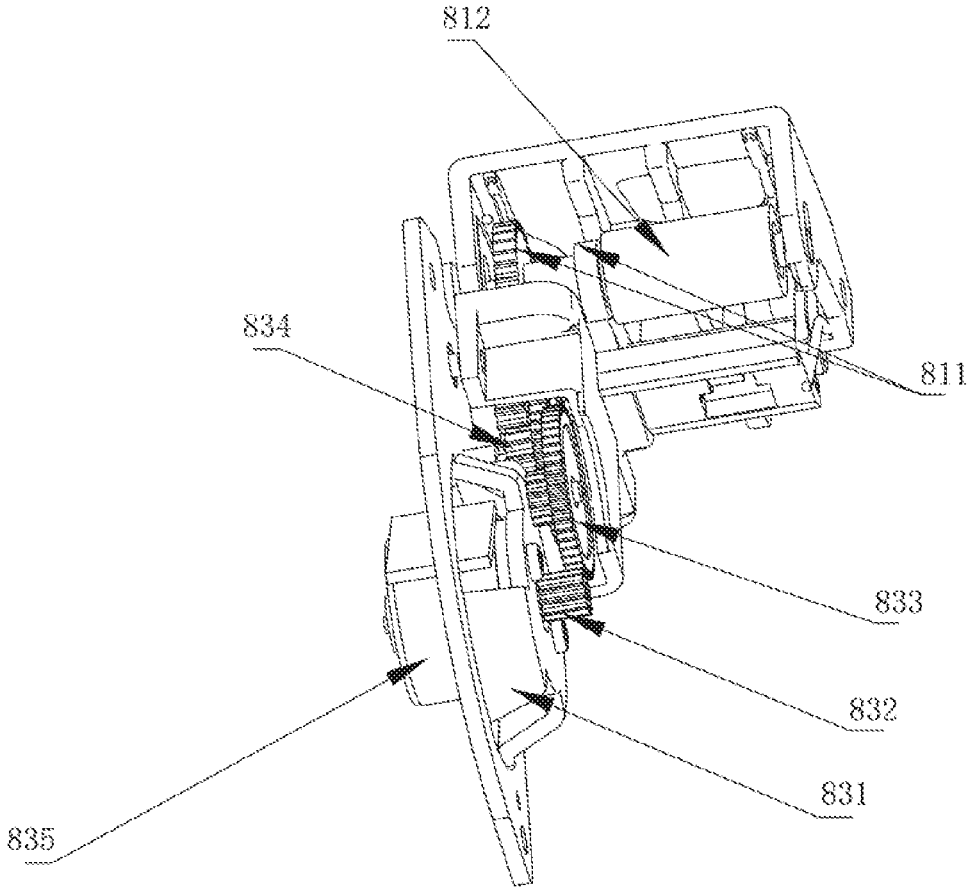
FIG. 6 is a structural schematic diagram of a paper feeding control mechanism of the label printer according to one embodiment of the present disclosure.

As shown in FIG. 6, the gear assembly includes a gear base 831, a pinion gear 832, a first transmission gear 833, and a second transmission gear 834. The rubber covered roller assembly includes a rubber covered roller gear 811 and a paper guide rubber covered roller 812. The pinion gear 832 is fixed on the gear base 831 and connected with a drive shaft of the stepper motor 835. The pinion gear 832 is engaged with the first transmission gear 833, the first transmission gear 833 is engaged with the second transmission gear 834, the second transmission gear 834 is engaged with the rubber covered roller gear 811, and the rubber covered roller gear 811 is movably connected with paper guide rubber covered roller 812. Thus, the stepper motor 835 drives the pinion gear 832 to rotate while driving the paper guide rubber covered roller 812 to rotate.

Figure 7:
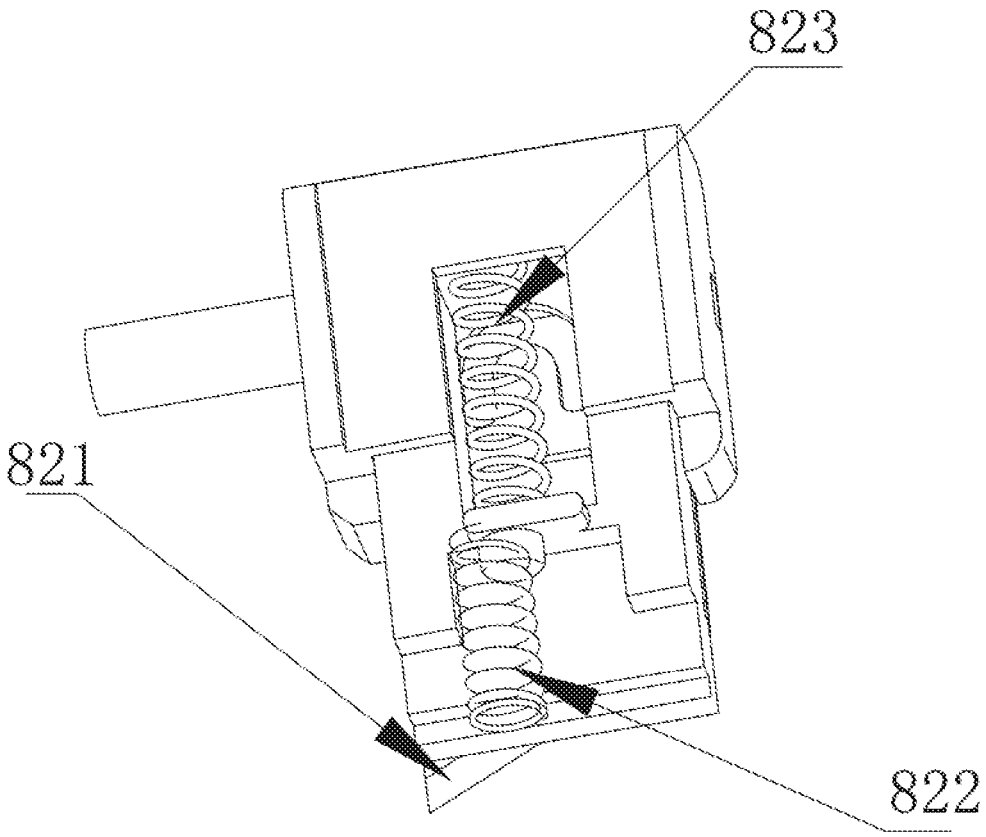
FIG. 7 is a structural schematic diagram of a paper cutter support assembly of the label printer according to one embodiment of the present disclosure.

As shown in FIG. 7, a paper cutter support assembly is disposed inside the accommodation cavity formed by the middle cover assembly 70 and the lower cover assembly 80. The paper cutter support assembly includes a second frame and a paper cutting blade 821. The paper cutting blade 821 is supported by a fulcrum on one side of the second frame and driven by a spring assembly. The paper cutting blade is configured to cut printing paper on the rubber covered roller assembly, and the spring assembly is supported by the second frame. The spring assembly includes a first spring 822 and a second spring 823.

A cutter sliding key 701 and a power button 702 are disposed on an outer surface of the middle cover assembly 70.

A transparent window 61 is disposed on an upper surface of the upper cover assembly 60.

One embodiment of an installation method for the label printer and the ribbon cassette is as following:

In an installation process of the ribbon cassette 200, clamping the print head 111 of the label printer 300 into the print head clamping groove 1 through the clamping inlet; matching and fixing the three position columns disposed on the label printer 300 with the three clamping accommodation parts disposed on the ribbon cassette 200; matching and fixing the position guidance column 211 disposed on the label printer 300 with the position hole 21 disposed on the ribbon cassette 200; forming the triangular region by the central imaginary line of the first clamping accommodation 40, the central imaginary line of the second clamping accommodation 50, and the central imaginary line of the third clamping accommodation 21 to form a stable triangular structure; then limiting a degree of freedom of the ribbon cassette 200 in all directions.

In the above process, the print head 111 is pressed to slightly open the clamping inlet through elasticity of plastic materials, when the print head 111 is clamped into the print head clamping groove 1, the clamping inlet is self-restored, so that the ribbon cartridge 200 is installed inside the label printer 300.

Therefore, the ribbon cassette of the present disclosure is accurately and smoothly assembled into a cassette installation part of the label printer. During printing, the present disclosure ensures that the ribbon cassette is positioned stably and the cutter does accurately and completely cut. An overall volume of the ribbon cassette is decreased, an internal capacity of the ribbon cassette is increased, and appearance fluency of the ribbon cassette is improved.

It should be noted that the above is merely a preferred embodiment of the present disclosure, but inventive concept is not limited thereto, and the inventive concept is intended to cover such modifications as fall within the scopes of the present disclosure.

What is claimed is:

1. A ribbon cassette, comprising a cassette housing, wherein:

a print head clamping groove, a side wall, and a position hole located inside the side wall are disposed on the cassette housing; a ribbon cutting part is formed at a connection between the side wall and the print head clamping groove; a first clamping accommodation part, a second clamping accommodation part, and a third clamping accommodation part are disposed on a surface of the cassette housing; the first clamping accommodation part, the second clamping accommodation part, and the third clamping accommodation part are respectively matched with a first position column, a second position column, and a third position column of a label printer; and a central imaginary line of the first clamping accommodation part, a central imaginary line of the second clamping accommodation part, and a central imaginary line of the position hole form a triangular region, the print head clamping groove comprises a first clamping part and a second clamping part, the first clamping part bends into the print head clamping groove to form a clamping inlet with the second clamping part, an aperture of the clamping inlet is smaller than a length dimension of the print head clamping groove, a print head of the label printer is clamped into the print head clamping groove through the clamping inlet, the print head is pressed to slightly open the clamping inlet through elasticity of plastic materials, when the print head is clamped into the print head clamping groove, the clamping inlet is self-restored.

2. The ribbon cassette according to claim 1, wherein:

the cassette housing comprises an upper cassette housing and a lower cassette housing; the upper cassette housing and the lower cassette housing are detachably and fixedly connected.

3. The ribbon cassette according to claim 2, wherein:

the first clamping accommodation part, the second clamping accommodation part, and the third clamping accommodation part are disposed on a surface of the upper cassette housing; the lower cassette housing comprises the side wall and the position hole located inside the side wall; the first clamping accommodation part, the second clamping accommodation part, and the third clamping accommodation part are in a same horizontal plane; and the first clamping accommodation part and the position hole are in different horizontal planes.

4. The ribbon cassette according to claim 3, wherein:

a connecting line connected to the first clamping accommodation part and the second clamping accommodation part is a first imaginary line; a connecting line connected to the first clamping accommodation part and the position hole is a second imaginary line; a connecting line connected to the second clamping accommodation part and the position hole is a third imaginary line; an angle formed after connecting the first imaginary line with the second imaginary line is an acute angle; an angle formed after connecting the first imaginary line with the third imaginary line is an acute angle; and an angle formed after connecting the second imaginary line with the third imaginary line is an acute.

5. The ribbon cassette according to claim 4, wherein at least one portion of the print head clamping groove and the ribbon cutting part overlaps the triangular region.

6. The ribbon cassette according to claim 4, wherein the side wall, comprises an extension part, the ribbon cutting part is formed at a connection between the extension part and the second clamping part, so that the ribbon cutting part is located at the connection is at an acute angle between the extension part and the second clamping part.

7. A label printer, comprising:

a printer housing, consisting of an upper cover assembly, a middle cover assembly, and a lower cover assembly; and a ribbon cassette, disposed inside the printer housing;

wherein a ribbon cassette placement part, configured to fix and hold the ribbon cassette, is disposed on the middle cover assembly; a first position column, a second position column, a third position column, and a position guidance column are disposed on the ribbon cassette placement part; the first position column, the second position column, and the third position column are respectively matched with a first clamping accommodation part, a second clamping accommodation part, and a third clamping accommodation part of the ribbon cassette; and the position guidance column is matched with a position hole of the ribbon cassette;

wherein the ribbon cassette comprises a print head clamping head; the print head clamping groove comprises a first clamping part and a second clamping part, the first clamping part bends into the print head clamping groove to form a clamping inlet with the second clamping part, an aperture of the clamping inlet is smaller than a length dimension of the print head clamping groove, a print head of the label printer is clamped into the print head clamping groove through the clamping inlet, the print head is pressed to slightly open the clamping inlet through elasticity of plastic materials, when the print head is clamped into the print head clamping groove, the clamping inlet is self-restored.

8. The label printer according to claim 7, wherein the middle cover assembly and the lower cover assembly form an accommodation cavity, and a paper feeding control mechanism is disposed inside the accommodation cavity; the paper feeding control mechanism comprises a first frame, a rubber covered roller assembly, a gear assembly, and a stepper motor; the rubber covered roller assembly is rotatably disposed on the first frame, the gear assembly and the stepper motor are disposed on one side of the first frame, the stepper motor is in transmission connection with the gear assembly, and the stepper motor drives the gear assembly to rotate while driving the rubber covered roller assembly to rotate.

9. The label printer according to claim 8, wherein a paper cutter support assembly is disposed inside the accommodation cavity formed by the middle cover assembly and the lower cover assembly; the paper cutter support assembly comprises a second frame and a paper cutting blade; the paper cutting blade is supported by a fulcrum on one side of the second frame and driven by a spring assembly; the paper cutting blade is configured to cut printing paper on the rubber covered roller assembly; and the spring assembly is supported by the second frame.

10. An installation method for label printer and ribbon cassette, comprising:

in an installation process of the ribbon cassette, clamping a print head of the label printer into a print head clamping groove through a clamping inlet; matching and fixing three position columns disposed on the label printer with three clamping accommodation parts disposed on the ribbon cassette; matching and fixing a position guidance column disposed on the label printer with a position hole disposed on the ribbon cassette; forming a triangular region by a central imaginary line of the first clamping accommodation, a central imaginary line of the second clamping accommodation, and a central imaginary line of the third clamping accommodation to form a stable triangular structure; then limiting a degree of freedom of the ribbon cassette in all directions; wherein, the print head is pressed to slightly open the clamping inlet through elasticity of plastic materials, when the print head is clamped into the print head clamping groove, the clamping inlet is self-restored, so that the ribbon cartridge is installed inside the label printer.

11. The ribbon cassette according to claim 1, wherein:

a ribbon cutting part is formed at a connection between the side wall and the print head clamping groove, the side wall comprises an extension part, the ribbon cutting part is formed at a connection between the extension part and the second clamping part, and the ribbon cutting part is located at the connection is at an acute angle between the extension part and the second clamping part.

12. The ribbon cassette according to claim 11, wherein:

at least one portion of the print head clamping groove and the ribbon cutting part overlaps the triangular region, and at least one portion of a print head insertion region and a ribbon cutting region is within the triangular region.

* * * * *